US009421785B1

(12) United States Patent
Vankouwenberg et al.

(10) Patent No.: US 9,421,785 B1
(45) Date of Patent: Aug. 23, 2016

(54) APPARATUS FOR INHIBITING SEDIMENT FORMATION IN A MICR INK SUB-TANK

(71) Applicant: Xerox Corporation, Norwalk, CT (US)

(72) Inventors: David Alan Vankouwenberg, Avon, NY (US); Jason M. Lefevre, Penfield, NY (US); Frank Berkelys Tamarez Gomez, Houston, TX (US); Steven M. Russel, Bloomfield, NY (US); Timothy P. Foley, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/956,665

(22) Filed: Dec. 2, 2015

(51) Int. Cl.
*B41J 2/175* (2006.01)

(52) U.S. Cl.
CPC ..... *B41J 2/17566* (2013.01)

(58) Field of Classification Search
CPC ..... B41J 2/17566
See application file for complete search history.

(56) References Cited

U.S. PATENT DOCUMENTS

| | | | | |
|---|---|---|---|---|
| 4,405,370 | A * | 9/1983 | Soga | H01F 1/442 106/31.64 |
| 5,382,963 | A * | 1/1995 | Pond | G06K 1/125 346/25 |
| 2007/0040877 | A1* | 2/2007 | Kachi | B41J 2/17566 347/86 |
| 2012/0127243 | A1* | 5/2012 | Kumagai | B41J 2/18 347/85 |

* cited by examiner

*Primary Examiner* — Manish S Shah
*Assistant Examiner* — Roger W Pisha, II
(74) *Attorney, Agent, or Firm* — Philip E. Blair; Fleit Gibbons Gutman Bongini & Bianco P.L.

(57) ABSTRACT

What is disclosed is an apparatus and method for inhibiting the formation of sediment in an ink sub-tank of a MICR inkjet printer. In one embodiment, the present apparatus comprises an ink sub-tank containing MICR ink substantially comprising a ferrofluid of particles, and an electromagnet. When the MICR inkjet printer is turned OFF, the electromagnet is lowered into a chamber inside the ink sub-tank and an electric current is applied to activate the electromagnet. Activation of the electromagnet causes the particles of the ferrofluid to be attracted to the electromagnet's magnetic field such that the particles are lifted off a bottom of the sub-tank to inhibit sediment formation thereon. The electromagnet is de-activated when the MICR inkjet printer is turned OFF. A sensor is employed to activate the electromagnet when sediment in the ink sub-tank has reached a pre-determined level.

19 Claims, 4 Drawing Sheets

APPARATUS FOR INHIBITING SEDIMENT FORMATION IN A MICR INK SUB-TANK

TECHNICAL FIELD

The present invention is directed to a method and apparatus for inhibiting sediment from forming in an ink sub-tank containing a ferrofluid of particles in a Magnetic Ink Character Recognition (MICR) inkjet printer.

BACKGROUND

Magnetic Ink Character Recognition (MICR) printing is most frequently used for checks, warrants, drafts, negotiable instruments, rebate coupons, invoices, statements, remittances, control documents, document security, to name a few. MICR ink is a ferrofluid of metallic particles. When the MICR system is not being used, ink sedimentation forms in the ink tank which may cause the system to clog. Clogging in the ink sub-tank is a primary concern and can be costly to repair. The present invention is specifically directed to inhibiting the formation of sediment in an ink sub-tank of a MICR inkjet printer.

BRIEF SUMMARY

In one embodiment, the apparatus of the present invention comprises an ink sub-tank containing a liquid MICR ink substantially comprising a ferrofluid of particles. A centrally located chamber extends from a top of the sub-tank down into the sub-tank.

The chamber houses a magnet which can be a permanent magnet or an electromagnet. When the MICR inkjet printer is turned OFF, a controller lowers the magnet down into the chamber such that the particles are attracted to the magnet's magnetic field thereby lifting at least a portion of the particles off a bottom of the sub-tank to inhibit sediment formation thereon. When the MICR inkjet printer is turned ON, the controller raises the magnet out of the chamber. A sensor may be employed to signal the controller in response to sediment in the ink sub-tank having reached a pre-determined level, a flow-rate of liquid ink through the sub-tank having fallen below a threshold level, and a pressure inside the sub-tank having reached a threshold level. Features and advantages of the present invention will become readily apparent from the following detailed description and accompanying drawings.

BRIEF DESCRIPTION OF THE DRAWINGS

The foregoing and other features and advantages of the subject matter disclosed herein will be made apparent from the following detailed description taken in conjunction with the accompanying drawings, in which.

DETAILED DESCRIPTION

Figure 1:
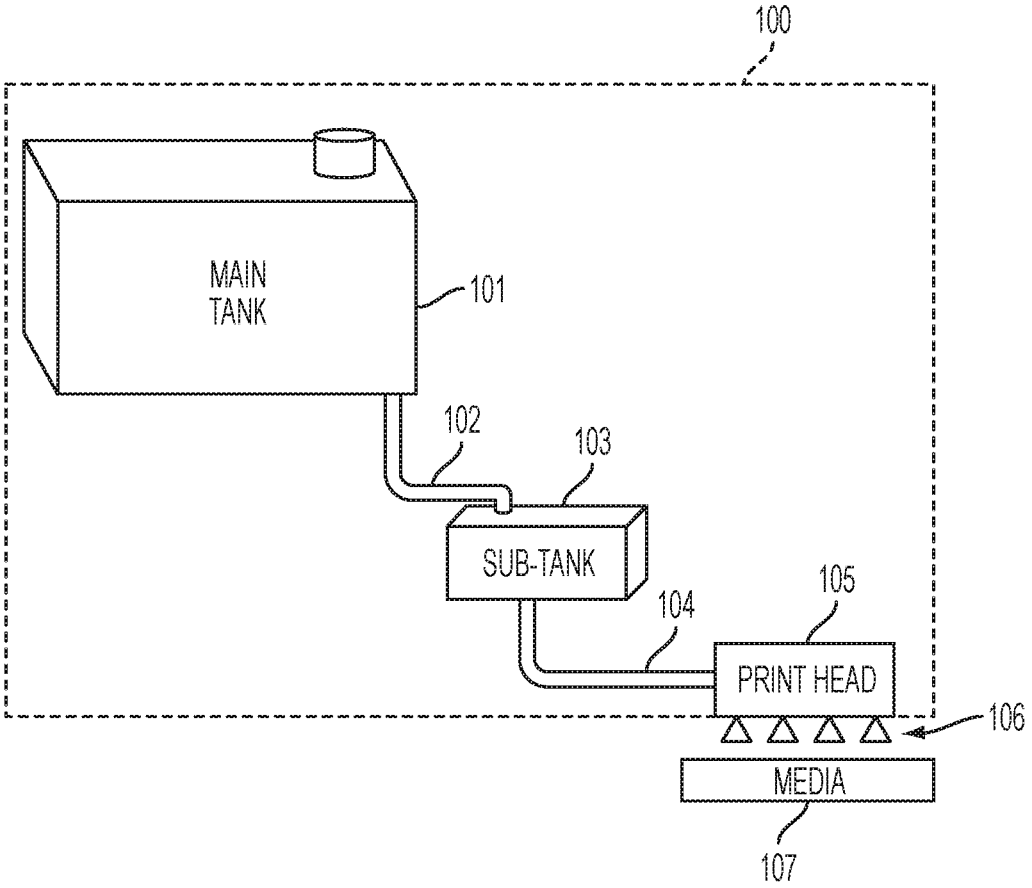
FIG. 1 shown one example embodiment of MICR inkjet printer to illustrate the relative relationship between the main tank, sub-tank, and printhead.

What is disclosed is a system and method for inhibiting the formation of sediment in an ink sub-tank of a Magnetic Ink Character Recognition (MICR) inkjet printer device. It should be appreciated that one of ordinary skill in this art would be readily familiar with various aspects of print devices utilizing inkjet technology as well as liquid MICR inks and ink sub-tanks, to which the teachings hereof are directed.

A "Magnetic Ink Character Recognition (MICR)" is a technology used mainly by the financial/banking industry to facilitate the processing and clearance of checks and other financial documents. MICR encoding can be seen at the bottom of a check and other vouchers and may include a routing number, account number, and the like. This technology allows MICR readers to read the printed characters directly into a data-collection device without the need for a user intervention. Unlike barcodes, MICR characters can be read by humans. The E-13B font set (numbers & symbols) has been adopted as an international standard. For more information about MICR technology, the reader is directed to: Xerox Publication No. 701 P22140, entitled: "Generic MICR Fundamentals Guide", (January 2003).

A "MICR inkjet printer" is an inkjet printer, as is generally understood, which operates by propelling variably-sized droplets of liquid ink (often mixed with a colorant) onto a media substrate. The output print is formed by the visual integration of the droplets on the paper. MICR inkjet systems operate no differently from an identical non-MICR inkjet system. Example MICR inkjet printers available in different streams of commerce include variants of the Xerox CiPress™ Production Inkjet Systems which utilize an aqueous inkjet module as an additional print station to jet MICR ink onto a media.

"MICR Ink" is a ferrofluid which contains very small particles (typically iron oxide) suspended in an aqueous solution. The ferrofluid may further contain a surfactant and a colorant. Characters printed with MICR inks have the property that they can be reliably read by a magnetic reader in a manner not too dissimilar to a magnetic tape reader and can even be reliably read if they have been overprinted or obscured by markings such as a cancellation stamp, a signature, scribbling, and the like. The error rate for a machine reading characters printed with MICR ink on a typical bank check is about 1 per 100,000 characters. MICR ink can be printed on most paper, although Xerox recommends a 90 gsm paper with a Sheffield smoothness of 80-150 and a 60% minimum reflectance. (See, Chapter 3, of the aforementioned Xerox Publication entitled: "Generic MICR Fundamentals Guide").

"Metallic particles", or simply "particles" is intended to refer to any sized particle of any chemical composition within the ferrofluid which facilitates the MICR ink's intended purpose. As such, the appended claims are not to be viewed as being limited to particles of a particular size, shape, or composition. The MICR ink resides in an ink sub-tank.

A "sub-tank" refers to an often smaller-sized ink tank into which MICR ink is gravity fed (or pressure fed) via a feed-line or tube from an often larger main ink tank. It should be appreciated that the sub-tank may be the main tank, depending on the design. The ink is transferred on-demand from the tank to one or more inkjet printheads which propel the ink onto the media. FIG. 1 serves to illustrate certain aspects of one generic embodiment of a MICR inkjet printer 100. Main tank 101 provides MICR ink to sub-tank 103 via feed-line 102. The MICR ink is then piped (generally at 104) to an inkjet printhead 105 which, in turns, propels the ink through a plurality of jets (collectively at 106) onto a media substrate 107.

Figure 2:
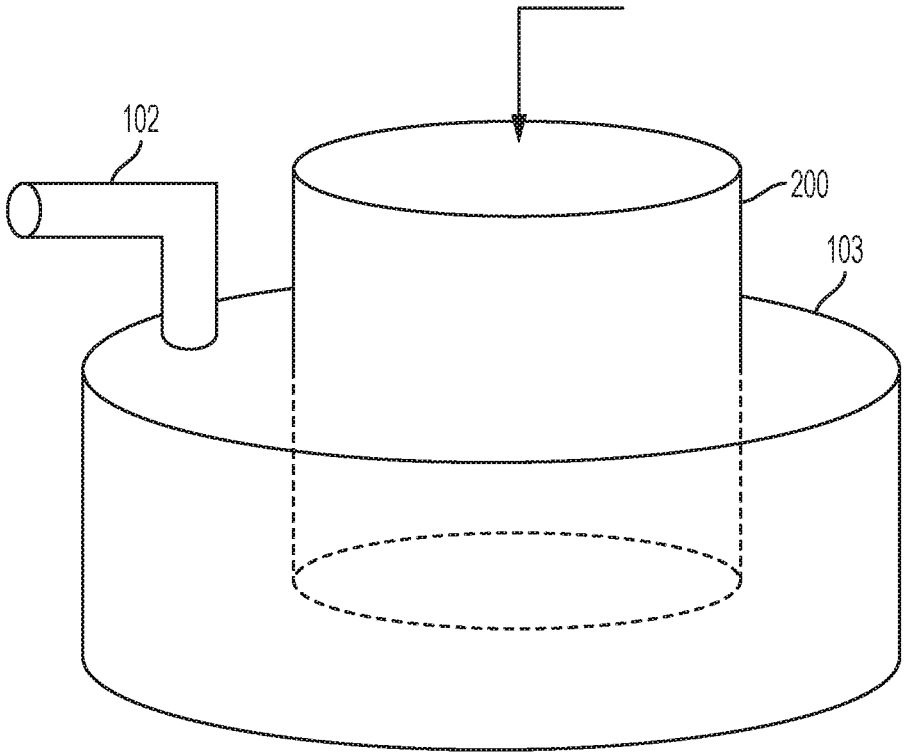
FIG. 2 shows an embodiment of a location of a chamber inside the sub-tank of FIG. 1.

A "chamber" is a place into which the magnet is lowered. The chamber is preferably sealed such that the MICR ink does not come into contact with the magnet itself. Reference is now being made to FIG. 2 shows an embodiment of a location of a chamber 200 inside the sub-tank 103 of FIG. 1. Although the chamber of FIG. 2 is shown as being substantially cylindrical, the chamber can have any of a variety of shapes depending on the implementation. As such, the scope of the appended claims should not be viewed as being limited strictly to cylindrically shaped chambers. As disclosed herein, sediment formation is inhibited by a magnetic field produced by either a magnet lowered into a chamber inside the ink sub-tank.

A "magnet" refers to either a permanent magnet or an electromagnet.

A "permanent magnet" generally comprises one of the following: Iron (Fe), Nickel (Ni), Boron (B), Cobalt (Co), Neodymium (Nd), Samarium (Sm), or a combination hereof. The magnet can have any shape such as, for instance, disc, cylindrical, square, ring, spherical, bar, helical, horseshoe, and arcuate. When the permanent magnet is lowered into a chamber in the ink sub-tank, the particles of the ferrofluid are attracted to the magnetic field and are lifted off a bottom of the sub-tank thereby inhibiting sediment formation thereon.

An "electromagnet" typically consist of a plurality of closely spaced turns of wire wound around a ferromagnetic core. As electric current passes through the wound wire, a magnetic field is generated. Unlike a permanent magnet, an electromagnet requires a continuous supply of electricity to maintain the magnetic field. One advantage of an electromagnet is that the magnetic field can be changed by regulating the current. When the electromagnet is lowered into a chamber in the ink sub-tank and activated, the particles of the ferrofluid are attracted to the magnetic field and are lifted off a bottom of the sub-tank thereby inhibiting sediment formation thereon.

"Activating the electromagnet" means applying an electric current to the electromagnet sufficient to produce and maintain the desired magnetic field generated thereby.

"Lowering the magnet" means to physically lower a magnet into a chamber in the ink sub-tank. Lowering the magnet can be performed either manually or by a controller. In the embodiment which employs an electromagnet, lowering the electromagnet means to: physically lower the electromagnet into the chamber, activate the electromagnet so that it generates a magnetic field, or both. The magnet can be lowered into a chamber in the sub-tank in response to, for example, the MICR inkjet printer having been turned OFF, the MICR inkjet printer being idle for a pre-defined amount of time, sediment in the sub-tank reaching a pre-determined level, a flow-rate of liquid ink through the sub-tank being at or below a threshold, pressure in the sub-tank having reached or exceeded a threshold, and a user turning, for example, a switch or dial, or making a selection using a keyboard, mouse, or from a touchscreen display integral to the printer, or from a workstation in wired or wireless communication with the printer.

"Raising the magnet" means to physically lift the magnet in a direction which is substantially perpendicular to the bottom of the sub-tank so the particles of the ferrofluid are no longer attracted to the magnet's magnetic field. Raising the magnet can be performed either manually or by a controller. The magnet can be raised completely out of the chamber. In the embodiment which employs an electromagnet, raising the electromagnet means to: physically lift the electromagnet, de-activate the electromagnet so that it no longer generates a magnetic field, or both. The magnet can be raised in response to any of: the MICR inkjet printer being turned ON, sediment levels reducing, flow rate of ink through the sub-tank increasing, pressure in the sub-tank decreasing, the passage of a pre-determined amount of time, and a user turning, for example, a switch or dial, or making a selection using a keyboard, mouse, or from a touchscreen display integral to the printer, or from a workstation in wired or wireless communication with the printer. Sensors and controllers can be employed.

A "sensor" refers to an analog or digital sensing device which sends a signal in response to what is being sensed. In one embodiment, the sensor is designed to sense a flow-rate of liquid ink flowing through the sub-tank and generate an output signal when the flow-rate falls below a pre-defined threshold level. The output signal may be proportional to the flow-rate sensed. In another embodiment, the sensor is designed to sense pressure and generate an output signal when the pressure falls below a pre-defined threshold level. The output signal may be proportional to the pressure sensed. In yet another embodiment, the sensor is designed to sense sediment levels and generate an output signal when the level of sediment meets are exceeds a pre-defined threshold level. The output signal may be proportional to the sediment level.

Figure 3:
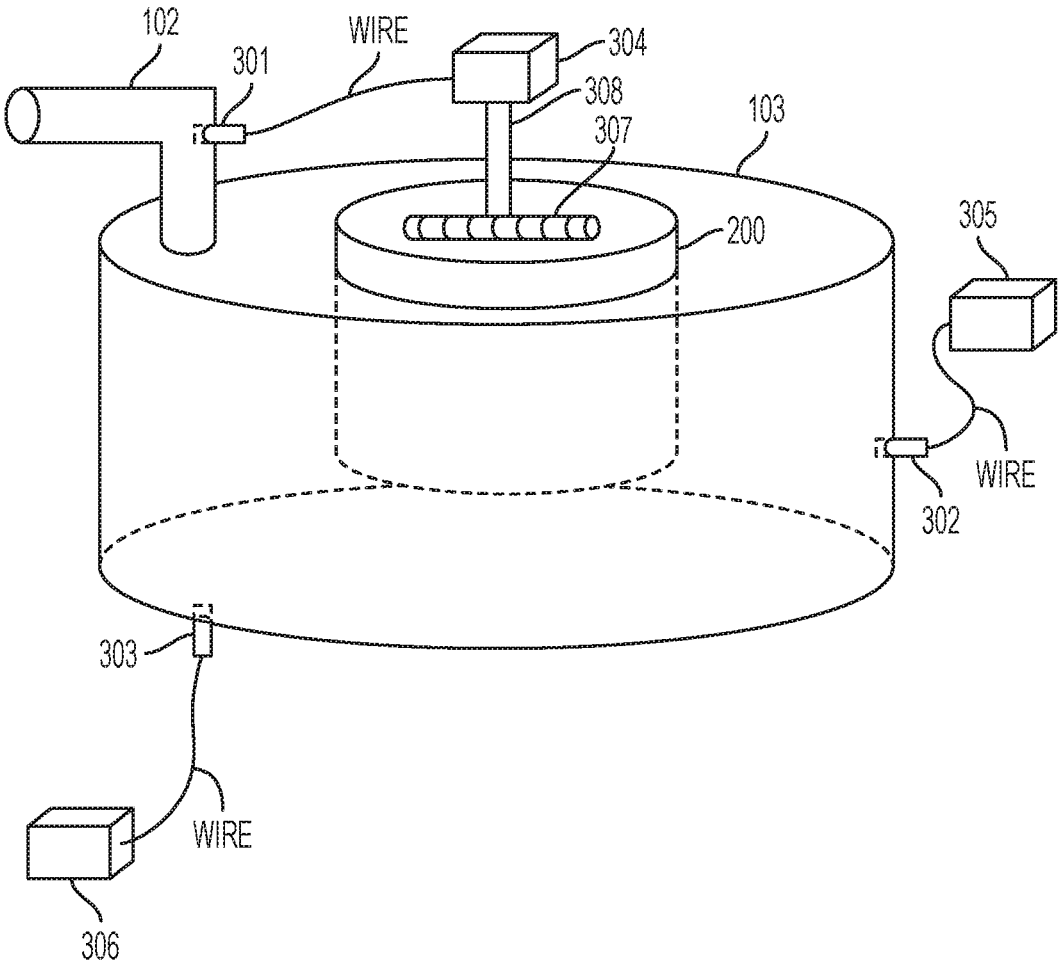
FIG. 3 shows a plurality of sensors used to sense flow-rate, pressure, and sediment level in accordance with various embodiments hereof.

Reference is now being made to FIG. 3 which shows a sensor 301 placed on, near, or through a wall of the feed-line to sense, for example, flow-rate and/or pressure. Sensor 302 is placed on, near, or through a sidewall of the sub-tank. Sensor 303 is placed on, near, or through a floor of the tank. The sensor may be placed on, near, or through a wall of the main tank (not shown). The sensor may be in wired or wireless communication with another device which performs the desired sensing. The sensor may be used to activate/de-activate an electromagnet or placed in communication with a controller.

A "controller", as is generally understood in the electrical arts, receives an input and, as a result of that input, initiates an action which controls another device or mechanism. In FIG. 3, sensors 301, 302 and 303 are shown in communication with a respective controller (shown generally at 304, 305 and 306), all of which may the same controller. Although shown as boxes, any of the controllers can be a circuit, ASIC, a special purpose module, a processor, or the like. The controller receives a signal and, in various embodiments, raises/lowers the magnet into the chamber and/or activates/de-activates an electromagnet. In FIG. 3, controller 304 is connected to a cylindrically-shaped permanent magnet 307 by a non-metallic shaft 308. In this embodiment, sensor 301 signals controller 304 to lower/raise the permanent magnet into chamber 200 in response to flow-rate and/or pressure. It should be understood that controller 304 can also be placed in communication with sensors 302 and 303 depending on the implementation, and that magnet 307 may be an electromagnet. It should also be appreciated that the sensors and controllers of any of the figures hereof are individually or collectively connected to a power source (not shown) via connections not shown.

Block Diagram of Special Purpose Computer

Figure 4:
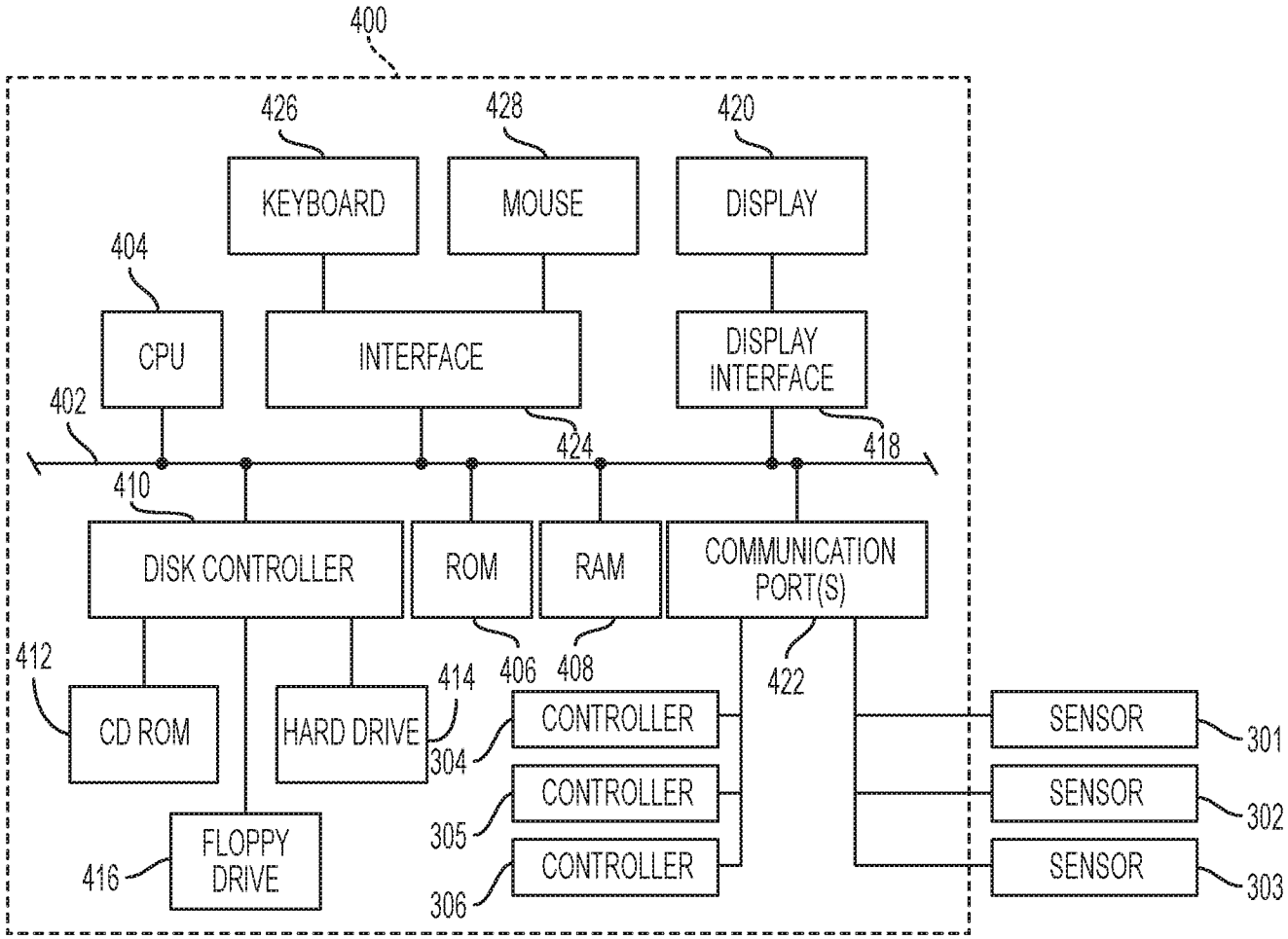
FIG. 4 illustrates a block diagram of one example special purpose computer for implementing various aspects hereof discussed with respect to the variously described embodiments.

Reference is now being made to FIG. 4 which illustrates a block diagram of one example special purpose computer for implementing various aspects hereof discussed with respect to the variously described embodiments. Such a special purpose computer is capable of executing machine executable program instructions for facilitating the performance of any of the sensors and controllers hereof, as well as to enable a user interaction therewith. Such a special purpose computer may comprise any of a micro-processor, micro-controller, ASIC, electronic circuit, or any combination thereof.

In FIG. 4, communications bus 402 is in communication with a central processing unit (CPU) 404 capable of executing machine readable program instructions for performing any of the calculations, comparisons, logical operations, and other program instructions for performing any of the steps described above with respect to the flow diagrams and illustrated embodiments hereof. Processor 404 is in communication with memory (ROM) 406 and memory (RAM) 408 which, collectively, constitute example storage devices. Such memory may be used to store machine readable program instructions and other program data and results to sufficient to carry out any of the functionality described herein. Disk controller 410 interfaces with one or more storage devices 414 which may comprise external memory, zip drives, flash memory, USB drives, or other devices such as CD-ROM drive 412 and floppy drive 416. Storage device stores machine executable program instructions for executing the teachings hereof. Such storage devices may be used to implement a database wherein various records are stored containing, for example, device specific flow-rates, device-specific pressure ranges, desired sediment levels, and the like.

Display interface 418 effectuates the display of information on display 420 in various formats such as, for instance, audio, graphic, text, and the like. Interface 424 effectuates a communication via keyboard 426 and mouse 528, collectively a graphical user interface. Such a graphical user interface is useful for a user to enter information as needed or to make a selection in accordance with various embodiments disclosed herein. Communication with external devices may occur using example communication port(s) 422. Shown is communication port(s) 422 being placed in communication with the sensors 301, 302 and 303 and controllers 304, 305 and 306 to effectuate the teachings hereof. Such ports may be placed in communication with devices over networks (not shown) such as, for example, the Internet or an intranet, either by wired or wireless links. Example communication ports include modems, network cards such as an Ethernet card, routers, a PCMCIA slot and card, USB ports, and the like, capable of transferring data from one device to another. Software and data is transferred via the communication ports which may be any of digital, analog, electromagnetic, optical, infrared, or other signals capable of being transmitted and/or received by the communications interface. Such signals may be implemented using, for example, a wire, cable, fiber optic, phone line, cellular link, RF, or other signal transmission means presently known in the arts or which have been subsequently developed.

The teachings hereof can be implemented using any known or later developed systems, structures, devices, and/or software by those skilled in the applicable art without undue experimentation from the functional description provided herein with a general knowledge of the relevant arts. The teachings hereof may be partially or fully implemented in software using object or object-oriented software development environments that provide portable source code that can be used on a variety of computer, workstation, server, network, or other hardware platforms. One or more of the capabilities hereof can be emulated in a virtual environment as provided by an operating system, specialized programs or leverage off-the-shelf computer graphics software such as that in Windows, Java, or from a server or hardware accelerator or other image processing devices.

One or more aspects of this disclosure are intended to be incorporated in an article of manufacture such as an inkjet printer capable of rendering MICR characters onto a media substrate. The article of manufacture may be included as part of a larger system which may be shipped, sold, leased, or otherwise provided separately either alone or as part of an add-on, update, upgrade, or product suite.

It will be appreciated that various of the above-disclosed and other features and functions, or alternatives thereof, may be combined into other systems, devices, or applications. Various presently unforeseen or unanticipated alternatives, modifications, variations, or improvements therein may become apparent and/or subsequently made by those skilled in the art which are also intended to be encompassed by the following claims. Accordingly, the embodiments set forth above are considered to be illustrative and not limiting. Various changes to the above-described embodiments may be made without departing from the spirit and scope of the invention.

The teachings of any printed publications including patents and patent applications, are each separately hereby incorporated by reference in their entirety.

What is claimed is:

1. A method for inhibiting sediment from forming in an ink sub-tank of a Magnetic Ink Character Recognition (MICR) inkjet printer, the method comprising:

lowering a magnet into a chamber inside an ink sub-tank containing a MICR ink substantially comprising a ferrofluid of particles such that said particles do not physically contact said magnet, said particles being attracted to said magnet's magnetic field such that at least a portion of said particles are lifted off a bottom of said sub-tank to inhibit sediment formation.

2. The method of claim 1, wherein said magnet is lowered into said sub-tank in response to said MICR inkjet printer being turned OFF and raised when said MICR inkjet printer is turned ON.

3. The method of claim 1, wherein said magnet is lowered into said sub-tank when said MICR inkjet printer has been idle for a pre-defined amount of time and raised prior to printing.

4. The method of claim 1, wherein, in response to said magnet having been lowered to a bottom of said sub-tank, lifting said magnet such that said magnet is raised slightly above said bottom of said sub-tank.

5. The method of claim 1, wherein said magnet is lowered into said sub-tank in response to a sensor indicating any of: that sediment in said sub-tank has reached a pre-determined level, that a flow-rate of liquid ink through said sub-tank has fallen below a threshold level, and that a pressure inside said sub-tank has reached a threshold level.

6. The method of claim 1, wherein said magnet comprises any of: Iron (Fe), Nickel (Ni), Boron (B), Cobalt (Co), Neodymium (Nd), Samarium (Sm), and a combination hereof.

7. The method of claim 1, wherein said magnet has a shape comprising any of: a disc, cylindrical, square, ring, spherical, bar, helical, horseshoe, and arcuate.

8. The method of claim 1, wherein said magnet is an electromagnet which is activated in response to any of: said MICR inkjet printer having been turned OFF, said MICR inkjet printer having been idle for a pre-defined amount of time, an amount of sediment in said sub-tank having reached a pre-determined level, a flow-rate of ink through said sub-tank having fallen below a threshold level, a pressure inside said sub-tank having risen above a threshold level, and a user input.

9. The method of claim 8, wherein said electromagnet is activated by a sensor indicating any of: that sediment in said sub-tank has reached a pre-determined level, that a flow-rate of liquid ink through said sub-tank has fallen below a threshold level, and that a pressure inside said sub-tank has reached a threshold level.

10. An apparatus for inhibiting sediment from forming in an ink sub-tank of a Magnetic Ink Character Recognition (MICR) inkjet printer, the apparatus comprising:

a sub-tank with a chamber, said sub-tank containing a liquid MICR ink substantially comprising a ferrofluid of metallic particles; and a controller for lowering a magnet into said chamber, wherein said magnet is lowered into said sub-tank in response to said MICR inkjet printer being turned OFF and raised when said MICR inkjet printer is turned ON, said metallic particles being attracted to said magnet's magnetic field such that at least a portion of said particles are lifted off a bottom of said sub-tank to inhibit sediment formation.

11. The apparatus of claim 10, further comprising a sensor which lowers said magnet in response to any of: that sediment in said sub-tank has reached a pre-determined level, that a flow-rate of liquid ink through said sub-tank has fallen below a threshold level, and that a pressure inside said sub-tank has reached a threshold level.

12. The apparatus of claim 10, wherein said magnet is lowered into said sub-tank when said MICR inkjet printer has been idle for a pre-defined amount of time and raised prior to printing.

13. The apparatus of claim 10, wherein, in response to said magnet being lowered to a bottom of said sub-tank, said controller lifting said magnet such that said magnet is above a bottom of said sub-tank.

14. The apparatus of claim 10, further comprising a sensor indicating any of: that sediment in said sub-tank has reached a pre-determined level, that a flow-rate of liquid ink through said sub-tank has fallen below a threshold level, and that a pressure inside said sub-tank has reached a threshold level.

15. The apparatus of claim 10, wherein said magnet comprises any of: Iron (Fe), Nickel (Ni), Boron (B), Cobalt (Co), Neodymium (Nd), Samarium (Sm), and a combination hereof.

16. The apparatus of claim 10, wherein said magnet has a shape comprising any of: a disc, cylindrical, square, ring, spherical, bar, helical, horseshoe, and arcuate.

17. The apparatus of claim 10, wherein said magnet is one of: a permanent magnet, and an electromagnet.

18. The apparatus of claim 17, wherein said electromagnet is activated in response to any of: said MICR inkjet printer having been turned OFF, said MICR inkjet printer having been idle for a pre-defined amount of time, an amount of sediment in said sub-tank having reached a pre-determined level, a flow-rate of ink through said sub-tank having fallen below a threshold level, a pressure inside said sub-tank having risen above a threshold level, and a user input.

19. The apparatus of claim 17, wherein said electromagnet is activated by a sensor indicating any of: that sediment in said sub-tank has reached a pre-determined level, that a flow-rate of liquid ink through said sub-tank has fallen below a threshold level, and that a pressure inside said sub-tank has reached a threshold level.

* * * * *